US006387580B2

(12) United States Patent
Anno et al.

(10) Patent No.: US 6,387,580 B2
(45) Date of Patent: May 14, 2002

(54) TONER SET AND FULL-COLOR IMAGE-FORMING METHOD SUITABLE FOR USE OF THE TONER SET

(75) Inventors: Masahiro Anno, Sakai; Katsunori Kurose, Amagasaki; Minoru Nakamura, Takarazuka; Chikara Tsutsui, Nishinomiya; Hiroyuki Fukuda, Sanda, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/855,538

(22) Filed: May 16, 2001

Related U.S. Application Data

(62) Division of application No. 09/288,022, filed on Apr. 8, 1999, now Pat. No. 6,265,125.

(30) Foreign Application Priority Data

Apr. 10, 1998 (JP) ..... 10-098801
Mar. 8, 1999 (JP) ..... 11-060074

(51) Int. Cl.[7] ..... G03G 13/01
(52) U.S. Cl. ..... 430/45
(58) Field of Search ..... 430/45, 110.3, 430/107.1

(56) References Cited

U.S. PATENT DOCUMENTS

| | | | | |
|---|---|---|---|---|
| 4,996,126 | A | | 2/1991 | Anno et al. |
| 5,066,558 | A | | 11/1991 | Hikake et al. |
| 5,126,221 | A | | 6/1992 | Chiba et al. |
| 5,206,109 | A | | 4/1993 | Anno |
| 5,300,383 | A | | 4/1994 | Tsubota et al. |
| 6,001,527 | A | | 12/1999 | Ishihara et al. |
| 6,033,817 | A | | 3/2000 | Yusa et al. |
| 6,051,350 | A | | 3/2000 | Inaba et al. |
| 6,072,964 | A | * | 6/2000 | Abe et al. ..... 399/69 |

FOREIGN PATENT DOCUMENTS

| | | |
|---|---|---|
| JP | 63319037 | 12/1988 |
| JP | 01257857 | 10/1989 |
| JP | 04226476 | 8/1992 |
| JP | 06317928 | 11/1994 |
| JP | 06317933 | 11/1994 |
| JP | 9-258474 | 10/1997 |

* cited by examiner

*Primary Examiner*—Christopher Rodee
(74) *Attorney, Agent, or Firm*—McDermott, Will & Emery

(57) ABSTRACT

The present invention provides a toner-set comprising yellow toner, magenta toner, cyan toner and black toner, in which the black toner comprises black toner particles comprising at least a binder resin and a black pigment and having a standard deviation of degree of roundness of not more than 0.045;

the yellow toner comprises yellow toner particles comprising at least a binder resin and a yellow pigment and having a standard deviation of degree of roundness of not more than 0.045 and an average degree of roundness larger than that of the black toner particles, the magenta toner comprises magenta toner particles comprising at least a binder resin and a magenta pigment and having a standard deviation of degree of roundness of not more than 0.045 and an average degree of roundness larger than that of the black toner particles, and the cyan toner comprises cyan toner particles comprising at least a binder resin and a cyan pigment and having a standard deviation of degree of roundness of not more than 0.045 and an average degree of roundness larger than that of the black toner particles.

The present invention also provides a method for forming full-color images suitable for use of the toner set.

18 Claims, 2 Drawing Sheets

TONER SET AND FULL-COLOR IMAGE-FORMING METHOD SUITABLE FOR USE OF THE TONER SET

The present application is a Divisional application under 37 CFR 1.53(b) of prior application Ser. No. 09/288,022, filed Apr. 8, 1999 now U.S. Pat. No. 6,265,125 issued Jul. 24, 2001.

This application is based on applications No. Hei 10-098801 and Hei 11-060074 filed in Japan, the contents of which are hereby incorporated by reference.

BACKGROUND OF THE INVENTION

1. Field of the Invention

The present invention relates to a toner set used for full-color image-forming apparatuses, such as full-color copying machines and full-color printers, and especially for those full-color image-forming apparatuses in which toner images formed on an image-supporting member are pressed and transferred onto an intermediate transfer member in an overlapped manner for each color, and the toner image, transferred onto the intermediate transfer member, are pressed and transferred onto a recording member.

The present invention also concerns a full-color image-forming method in which the toner set is used.

2. Description of the Prior Art

Conventionally, image-forming apparatuses, such as copying machines, printers and facsimiles, have been widely used. In such image-forming apparatuses, an image-forming process is carried out by an electrophotographic system in which an electrostatic latent image formed on a photosensitive member is developed by toner and the toner image is transferred onto a recording member such as recording paper,, etc. Moreover, in recent years, full-color image-forming apparatuses, such as full-color copying machines and full-color printers, which reproduce full-color images by using toners having a plurality of colors, have been widely used.

Referring to a full-color image-forming apparatus shown in FIG. 2, a brief explanation will be given of these apparatuses. Upon formation of a full-color image, when a printing operation is started, a photoconductive drum 10 and an intermediate transfer belt 40 are rotationally driven with the same peripheral velocity and the photoconductive drum 10 is charged to a predetermined electric potential by a charging brush 11.

Successively, exposure for a yellow image is carried out by a laser scanning optical system so that an electrostatic latent image of the yellow image is formed on the photoconductive drum 10. This electrostatic latent image is immediately developed in a developing device 31Y, and the toner image is pressed and transferred onto the intermediate transfer belt 40 at a primary transfer section. Immediately after the primary transferring process has been finished, switching is made to a developing device 31M in the developing section D, and then exposure, developing and a primary transferring process for a magenta image are carried out. Moreover, switching is made to a developing device 31C, and exposure, developing and a primary transferring process for a cyan image are carried out. Furthermore, switching is made to a developing device 31Bk, and exposure, developing and a primary transferring process for a black image is carried out. In each of the primary transferring processes, the toner image is superimposed on the intermediate transfer belt 40.

After the final primary transferring process has been completed, a recording sheet S is sent to a secondary transfer section, and a full-color toner image, which has been formed on the intermediate transfer belt 40, is pressed and transferred onto the recording sheet S. After completion of the secondary transferring process, the recording sheet S is transferred to a belt-type contact-heating fixing device 70 in which the full-color toner image is fixed on the recording sheet S, and then is discharged onto the upper surface of a printer main body 1.

With respect to full-color developing toners, toners including a yellow toner, a magenta toner, a cyan toner and a black toner are loaded into respective developing devices for the respective colors. With respect to the shape of toner particles contained in the respective toners, all the toners have a uniform shape.

However, when the above-mentioned full-color developing toners and the full-color image-forming apparatuses are used, the transferring properties tend to deteriorate due to fluctuations in environmental conditions, such as temperatures and moisture, and transferring conditions at the time of the primary and secondary transferring processes, causing image losses in superimposed toner images having two or more colors and scattering of toner; this causes image noise such as defective images and image-fogging in the resulting full-color copied images. Moreover, another problem is raised in that in the case of a spherical particle shape of respective color toners, residual toner on the photosensitive member from the primary transferring process deposits in the gap between the surface of the photosensitive member and a cleaning member, causing a defective cleaning process (insufficient sweeping).

In order to solve the above-mentioned problems, attempts have been made to regulate setting conditions on the transferring process, cleaning, etc.; however, they have failed to solve all the above-mentioned problems at the same time, and restrictions imposed by the various conditions tend to raise new problems.

SUMMARY OF THE INVENTION

An objective of the present invention is to provide a toner set with superior transferring properties and cleaning properties, which does not cause image losses in toner images and toner scattering in the primary and secondary transferring processes, and can eliminate image-fogging in full-color copied images.

Another objective of the present invention is to provide a full-color image-forming method having superior transferring properties and cleaning properties, which does not cause image losses in toner images and toner scattering in the primary and secondary transferring processes, and can eliminate image-fogging in full-color copied images.

The present invention relates to a toner-set comprising yellow toner, magenta toner, cyan toner and black toner, in which

- the black toner comprises black toner particles comprising at least a binder resin and a black colorant and having a standard deviation of degree of roundness of not more than 0.045;
- the yellow toner comprises yellow toner particles comprising at least a binder resin and a yellow colorant and having a standard deviation of degree of roundness of not more than 0.045 and an average degree of roundness larger than that of the black toner particles,
- the magenta toner comprises magenta toner particles comprising at least a binder resin and a magenta colorant and having a standard deviation of degree of roundness of not more than 0.045 and an average degree of roundness larger than that of the black toner particles, and the cyan toner comprises cyan toner particles comprising at least a binder resin and a cyan colorant and having a standard deviation of degree of roundness of not more than 0.045 and an average degree of roundness larger than that of the black toner particles.

The present invention also relates to a method for forming full-color images suitable for use of the toner-set.

DETAILED DESCRIPTION OF THE INVENTION

Figure 1:
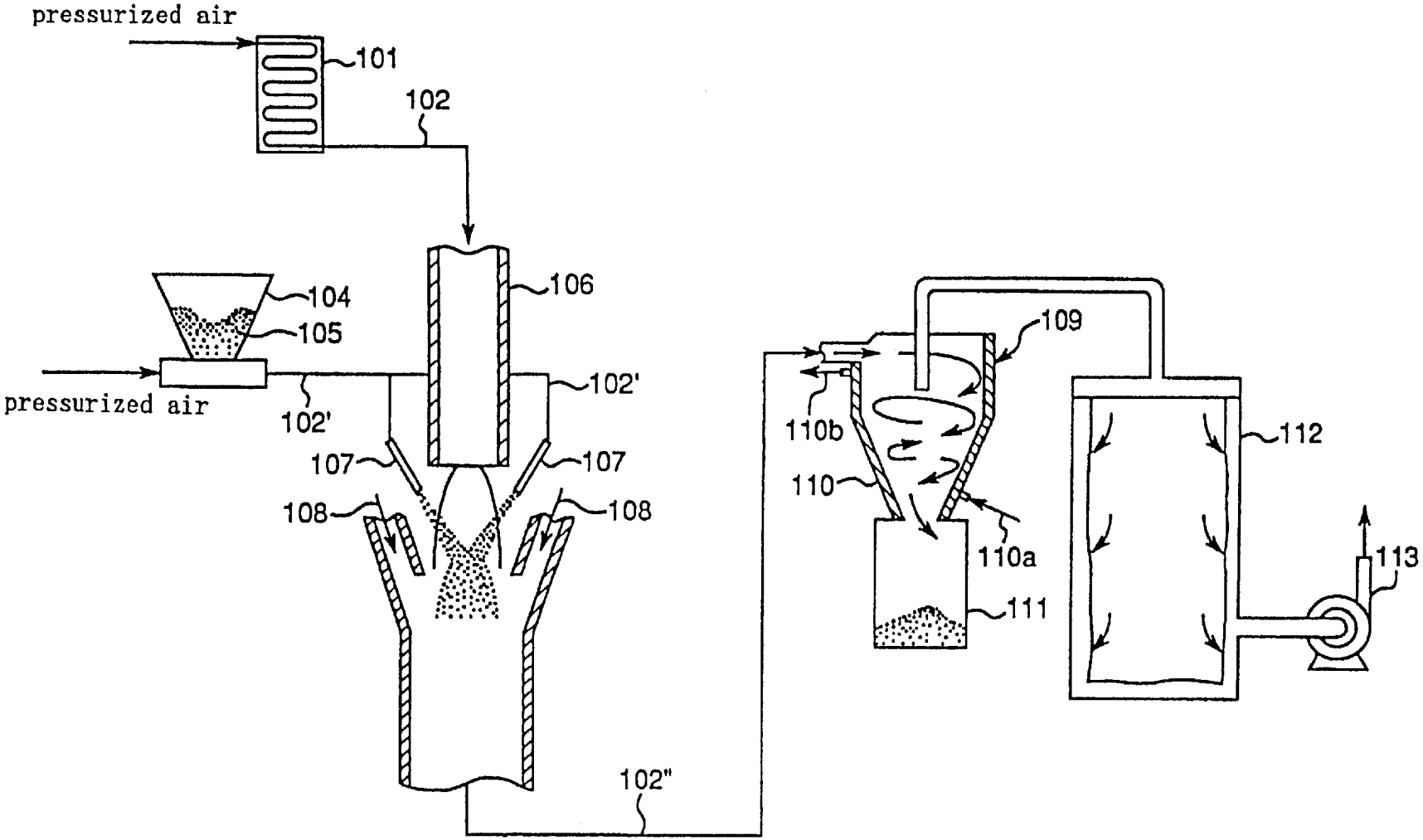
FIG. 1 is a schematic flow diagram showing a surface-modifying system used in the surface-modifying process of the toner.

The inventors, etc. of the present invention have taken into consideration the average degree of roundness of toners constituting the full-color developing toner, and have found that it is possible to provide a full-color developing toner and a full-color image-forming method having superior transferring properties which would not cause image losses in toner images and toner scattering during primary and secondary transferring processes, and can eliminate image-fogging etc. from full-color copied images, by setting the average degree of roundness of yellow toner, magenta toner and cyan toner (hereinafter, referred to as color toners) at not less than 0.95. Moreover, they also have found that, by setting the average degree of roundness of the color toners greater than that of the black toner, that is, by imparting a predetermined non-spherical properties to the black toner, it becomes possible to improve a cleaning process for toner accumulated in a gap between the surface of a photosensitive member and a cleaning member that is placed in press-contact with the photosensitive member so as to clean residual toner on the photosensitive member and the intermediate transfer member during the primary and secondary transferring processes. Furthermore, they have found that by regulating the standard deviation of the degree of roundness so as to suppress-the variation of the shape of each toner particle, it becomes possible to obtain superior durability so that even repeated copying processes would not adversely affect the quality of copied images.

In the present specification, "full-color developing toner" refers to a plurality of combined toners that are to be selected and loaded into the respective developing devices upon formation of a full-color image. Moreover, "toner" includes toner particles and desired additive agents such as a fluidity-aiding agent, and "average degree of roundness of toner" refers to the average degree of roundness of toner particles contained in the toner.

The full-color developing toner of the present invention is constituted by yellow toner, magenta toner, cyan toner and black toner. The respective average degree of roundness of yellow toner, magenta toner and cyan toner is set to be greater than that of black toner. In other words, the respective toner particles of yellow toner, magenta toner and cyan toner have higher degrees of sphericity than the black toner.

When toners constituting full-color developing toners are loaded into the respective developing devices, black toner is—although it depends on an image-forming system in question—loaded in a manner so as to form the black toner layer on the intermediate transfer member as the uppermost layer during the primary transferring process, in an attempt to alleviate the different appearance caused by its different glossing properties (luster properties) from that of the other colors by forming the black toner layer as the lowermost layer in the copied images. For this reason, in the present invention, if the average degree of roundness is small among color toners for forming superimposed images having two or more colors, that is, if the average degree of roundness among three or four kinds of toners is relatively low, any one of the color toner layers that have been directly formed onto the intermediate transfer member during the transferring process tends to be difficult to be separated from the transfer member, with the result that image losses and scattering of toner occur, thereby causing image noise. It is considered that, when the average degree of roundness of toner particles in the toner layers directly formed on the intermediate transfer member is relatively low, that is, when the degree of sphericity is low, the contact areas between the intermediate transfer member and the toner particles become larger, thereby causing a reduction in the transferring efficiency. In contrast, when the average degree of roundness of four kinds of toners is relatively high, there is a reduction in the cleaning properties for residual toner on the photosensitive member, which causes an insufficient cleaning process.

In the present description, the average degree of roundness is referred to as a value calculated from the following equation:

$$\text{Average Degree of Roundness} = \frac{\text{Circumferential Length of Circle Equal to Particle Projection Area}}{\text{Circumferential Length of Particle Projection Image}}$$

In this case, "circumferential length of circle equal to particle projection area" and "circumferential length of particle projection image" are values obtained by carrying out measurements in the aqueous dispersion system by using a flow-type particle image analyzer (FPIA-1000 or FPIA-2000; made by Toa Iyou Denshi K.K.). In this manner, in the present invention, the average degree of roundness is found from "the circumferential length of circle equal to particle projection area" and "the circumferential length of particle projection image". Therefore, the resulting value provides an index that correctly reflects the shapes of toner particles, that is, the protruding and recessed states of particle surfaces. Moreover, the value obtained by the above-mentioned analyzer is a value that is obtained as an average value of several thousands of particles; therefore, the average degree of roundness in the, present invention has very high reliability. Additionally, in the present description, the average degree of roundness is not necessarily measured only by the above-mentioned analyzer. Any device may be adopted as long as the measurements are carried out based upon the above-mentioned equation.

In the present invention, it is only necessary for the respective average degree of roundness of yellow toner, magenta toner and cyan toner to be set greater than that of black toner, as described earlier. However, it is preferable to set it in the range from 0.95 to 1.00, and more preferably from 0.96 to 1.00. Values less than 0.95 tend to cause image losses and scattering of toner, namely, image noise, as described earlier. With respect to black toner, the average degree of roundness is preferably set in the range of 0.94 to 0.97, and more preferably 0.95 to 0.97. Values less than 0.94 result in degradation in the image quality, such as fine-line reproducibility, etc., and values exceeding 0.97 cause a reduction in the cleaning effect for residual toner accumulated in the gap between the surface of the photosensitive member and the cleaning member; this tends to cause insufficient sweeping (a defective cleaning process) in environmental conditions such as L/L (Low temperature/Low moisture).

In the full-color developing toner of the present invention, the standard deviation of degree of roundness of all the toners is preferably set at not more than 0.045, more preferably, not more than 0.040, and most preferably, not more than 0.035. In the full-color developing toner constituted by a combination of color toners and black toner, if even one kind of toner whose standard deviation of degree of roundness exceeds 0.045 is contained therein, it causes degradation in durability. In other words, this tends to present problems in toner aggregating properties, transferring properties and graduation properties; such as toner stains adhering to regulating blades due to repeated copying processes and noise appearing on copied images in the form of a number of stripes. In the present description, the standard deviation of degree of roundness is referred to as a standard deviation in the distribution of degree of roundness. This value is obtained by the above-mentioned flow-type particle image analyzer simultaneously with the average degree of roundness. The smaller the value in question, the more uniform the toner particle shapes.

In this manner, in the present invention, the average degree of roundness of not less than several thousands of arbitrary toner particles is defined together with the standard deviation of degree of roundness by using the equation that reflects the shapes of toner particles correctly. Therefore, the full-color toner of the present invention is provided with a desired particle shape for each color-toner without shape-irregularity. The irregularity in the toner particle shapes is considered to give adverse effects on various toner properties and durability, such as uneven charging and selective developing and consumption of toners having a specific shape.

In the full-color developing toner in the present invention, a volume average particle size of toner particles of each toner is preferably set in the range from 2 to 10 $\mu$m; and more preferably 5 to 9 $\mu$m. Moreover, toner particles of toner preferably used in the present invention are preferably set so as to have a content of not more than 1% by weight of particles having not less than two times (2D) the volume average particle size (D), and more preferably not more than 0.5% by weight. Furthermore, they are also preferably set so as to have a content of not more than 5% by number of particles having not more than ⅓ (D/3) the volume average particle size (D), and more preferably, not more than 3% by number. If the rate of content of not less than 2D exceeds 1% by weight, or if the rate of content of not more than D/3 exceeds 5% by number, it becomes difficult to obtain the effects of the present invention. In the present description, the measurements of particle size of toner particles are carried out by using a Coulter Multisizer (made by Coulter counter K.K.) with an aperture diameter of 50 $\mu$m.

Color toners and black toner constituting the full-color developing toner of the present invention comprises respectively toner particles containing at least a binder resin and a colorant, and desired additive agents, such as, for example, fluidizing agent and cleaning assist agent.

The toner particles can be prepared by using a binder resin, a colorant and other desired additive agents through a known method such as a kneading and pulverizing method, a suspension polymerization method, an emulsion polymerization method, an emulsion dispersion granulation method, and an encapsulation method. Among these preparation methods, it is preferable to use the kneading and pulverizing method from the viewpoint of production cost and production stability. From the viewpoint of ease of control of the average degree of roundness, it is preferable to obtain toners through the kneading and pulverizing method, the suspension polymerization method, the emulsion polymerization method, etc. and then to shape-control these toners by means of mechanical impact force, thermal energy, etc.

In the kneading and pulverizing method, toner particles are prepared through the following steps: a step for mixing a binder resin, a colorant and other desired additive agents by using a mixer such as Henschel mixer, a step for fusing and kneading the mixture, a step for pulverizing the mixture that have been subjected to a cooling process, a step for finely pulverizing the roughly pulverized particles, and a step for classifying the resulting finely pulverizing particles.

In the case when toner particles are prepared by using the kneading and pulverizing method, any means may be adopted as long as it is possible to control the average degree of roundness of the toner particles to have the above-mentioned range. For example, a surface-modifying process is preferably carried out after the roughly pulverizing step, the finely pulverizing step or the fine-particle classifying step, by using, for example, the following surface-modifying devices: systems using a high-speed air-flow impact method, such as a Hybridization system (made by Nara Kikai Seisakusho K.K.), a Cosmos system (made by Kawasaki Juko K.K.), an Inomizer system (made by Hosokawa Micron K.K.) and a Turbo Mill (made by Turbo Kogyo K.K.), systems using a dry mechano-chemical method, such as a Mechanofusion system (made by Hosokawa Micron K.K.) and a Mechano Mill (made by Okada Seiko K.K.), systems using a heated air-flow modifying method, such as a Surfusing System (made by Nippon Pneumatic Kogyo K.K.) and a thermo-processing apparatus (made by Hosokawa Micron K.K.), and systems using a wet-coating method, such as a Dispacoat Disbar Coat (made by Nisshin Engineering K.K.) and a Coatmizer (made by Freund Sangyo K.K.).

Among the above-mentioned surface-modifying devices, it is most preferable to use Surfusing System (made by Nippon Pneumatic Kogyo K.K.) since it allows to control the degree of roundness to a great degree in achieving the objective of the present invention. Referring to FIG. 1, the following description will discuss this system. As illustrated in FIG. 1, a high-temperature, high-pressure air flow, generated in a heated-air-flow generation device 101, is discharged from a heated-air discharging nozzle 106 through an introduction tube 102. A predetermined amount of toner particles (sample) 105, which are to be subjected to a surface-modifying process, is transported by fixed-amount pressurized air from a fixed-amount provider 104 through an introduction tube 102', and discharged in a heated air flow through a sample-discharging nozzle 107 installed on the periphery of the heated-air discharging nozzle 106. In this case, it is preferable to provide a predetermined tilt to the sample-discharging nozzle 107 with respect to the heated-air discharging nozzle 106 so as not to allow the discharging flow from the sample-discharging nozzle 107 to cross the heated air flow. Moreover, one or a plurality of the sample-discharging nozzles 107 may be provided; however, it is: preferable to provide a plurality of the sample-discharging nozzles in a manner so as to face each other with the predetermined tilt in order to improve the dispersing properties of the sample in the heated air flow. In the case of using a plurality of sample-discharging nozzles, toner is preferably discharged toward the center of the heated air flow from the respective sample-discharging nozzles with each having the predetermined tilt. Thus, the toner particles collide with one another at the center of the heated air flow with appropriate forces so that the toner particles are sufficiently dispersed in the heated air flow, with the result that each of the toner particles is preferably subjected to a heating process uniformly. The toner particles discharged in this manner are allowed to be subjected to a uniform surface-modifying process when they are instantaneously made in contact with the high-temperature air flow.

Next, the toner particles, which have been subjected to the surface-modifying process, are rapidly cooled off by a cold air flow that is introduced from a cooled air-flow introduction section 108. Such rapid cooling prevents the toner particles from adhering to the device walls and from aggregating together, thereby making it possible to improve the yield. The toner particles are then collected into a cyclone 109 through an introduction tube 102", and accumulated in a production tank 111. The carrier air from which the toner particles have been removed further passes through a bug-filter 112 at which fine powder has been removed, and is discharged through a blower 113 to air. Here, a cooling jacket 110, in which cold water (110*a* and 110*b*) is circulating, is installed in the cyclone 109 so that the toner particles inside the cyclone are cooled by cooling water so as not to be aggregated.

For example, when fine particles having an average degree of roundness ranging from 0.92 to 0.95 and a particle size ranging from 2 to 10 $\mu$m, which have been obtained by a known kneading and pulverizing method, are subjected to a surface-modifying process by using Surfusing System under the conditions of process temperatures from 100 to 500° C., residence time from 0.1 to 3 sec., particle dispersion concentration from 10 to 200 g/m$^3$, cooling air flow temperature from 0 to 50° C. and cooling water temperatures from −10 to 25° C., the resulting toner particles have an average degree of roundness ranging from 0.93 to 1.00 and a volume-average particle size ranging from 2 to 10 $\mu$m.

After the toner fine particles have been obtained by the above-mentioned kneading and pulverizing method, it is preferable to perform a classifying process by using a classifier such as listed blow, before or after the surface-modifying process by the above-mentioned surface-modifying device, etc. in order to achieve the above-mentioned particle-size distribution. The following classifiers may be used on demand: a rotor-type classifier (Teeplex classifier Type: 100 ATP; made by Hosokawa Micron K.K.), a DS classifier (made by Nippon Pneumatic Kogyo K.K.), and an Elbow Jet classifier (made by Nittetsu Kogyo K.K.).

With respect to the binder resin in the toner particles of the full-color developing toner of the present invention, it is not specifically limited, but for example, styrene resins, acrylic resins, styrene-acrylic resins, polyamide resins, polyester resins, polyurethane resins, epoxy resins, and other known resins may be solely used, or in a mixture, and selection is preferably made so as to meet a specific purpose. For example, in the case for preparing for color toners, polyester resins are suitable, and in the case for preparing for black toner, polyester resins, styrene-acrylic resins and their mixture may be suited. In the present invention, polyester resins, which are suitable for both color toners and black toner, are most preferable from the viewpoints of image characteristics such as image losses, scattering and fogging, the transferring properties of toner, the fixing properties including an OHP light-transmitting properties, the cleaning properties and durability.

In the present invention, preferable polyester resins are the ones synthesized through a polycondensation reaction by using alcohol ingredients, such as bisphenol-A alkyleneoxide additives as main ingredients, and acid ingredients, such as phthalic acid type dicarboxylic acids, or phthalic acid type dicarboxylic acids and aliphatic dicarboxylic acids.

With respect to the bisphenol-A alkyleneoxide additives, bisphenol-A propyleneoxide additives and bisphenol-A ethyleneoxide additives are preferably used, and it is preferable to use these in a mixed manner.

In addition to the bisphenol-A alkyleneoxide additives, the following diols and polyhydric alcohols may be used slightly as alcohol ingredients. Such alcohol ingredients include, for example, diols, such as ethylene glycol, diethyleneglycol, triethyleneglycol, 1,2-propyleneglycol, 1,3-propyleneglycol, 1,4-butanediol and neopentylglycol, and sorbitol, 1,12,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene.

With respect to phthalic acid type dicarboxylic acids, terephthalic acid and isophthalic acid and their acid anhydrides or their lower alkylesters, etc. may be used.

With respect to aliphatic dicarboxylic acids that are usable together with phthalic acid type dicarboxylic acids, fumaric acid, maleic acid, succinic acid, aliphatic dicarboxylic acids such as alkyls of 4 to 18 carbons or alkenyl succinic acid, and their acid anhydrides or their lower alkylesters, etc. may be used.

Furthermore, in order to improve dispersibility of colorants in the binder resin, the binder resin is desirably provided with an acid value ranging from 1.0 to 30.0 KOHmg/g, preferably from 1.0 to 25.0 KOHmg/g, and more preferably from 2.0 to 20.0 KOHmg/g. If the acid value is less than 1.0 KOHmg/g, only a small effect is available in improving the dispersibility. If it exceeds 30.0 KOHmg/g, there are greater variations in electro static charge quantity due to environmental fluctuations.

In order to adjust the acid value of the binder resin, a slight amount of polyhydric carboxylic acids, etc. such as trimellitic acid may be used to an extent that would not impair the light-transmitting properties, etc. of toners. Such polyhydric carboxylic acid ingredients include, for example, 1.2.4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and their anhydrides and lower alkylesters.

The binder resin used in the toner particles in the present invention has a glass transition point ranging from 55 to 75° C., and more preferably from 60 to 70° C., a softening point ranging from 95 to 120° C., and more preferably, 100 to 118° C., a number-average molecular weight ranging from 2,500 to 6,000, and more preferably from 3,000 to 5,500, and a ratio of weight-average molecular weight/number-average molecular weight of 2 to 8, and more preferably 3 to 7. When the glass transition point is lower, the heat-resistance preserving properties of the toner is reduced, and when it is higher, the light-transmitting properties and the color-mixing properties are reduced. When the softening point is lower, high-temperature offset tends to occur in a fixing process. When it is higher, the fixing strength is lowered. When the number-average molecular weight is smaller, the toner tends to be easily separated from images upon being bent. When it is greater, the fixing strength is lowered. If the ratio of weight-average molecular weight/number-average molecular weight is smaller, high-temperature offset tends to occur, and if it is greater, the light-transmitting properties is reduced.

With respect to the colorants, various known colorants, such as magenta color, cyan color, yellow color, black, etc., may be used:

Magenta colorants include, for example, magenta pigments such as C. I. Pigment Reds 1, 2, 3, 4, 5, 6, 7, 8, 9, 10, 11, 12, 13, 14. 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 184, 202, 206, 207 and 209, and magenta dyes, such as C.I. Solvent Reds 1, 3, 8, 23, 24, 25, 27, 30, 49, 81, 82, 83, 84, 100, 109, 121, C. I. Disperse Red 9, and C. I. Basic Reds 1, 2, 9, 12, 13, 14, 15, 17, 18, 22, 23, 24, 27, 29, 32, 34, 35, 36, 37, 38, 39 and 40.

With respect to cyan colorants, for example, cyan pigments, such as C. I. Pigment Blue 2, 3, 15, 16, and 17, may be used.

Yellow colorants include, for example, yellow pigments, such as C. I. Pigment Yellow 1, 2, 3, 4, 5, 6, 7, 10, 11, 12, 13, 14, 15, 16, 17, 23, 65, 73, 83, 180 and 185, and C. I. Bud Yellow 1, 3 and 20, and yellow dyes such as C. I. Solvent Yellow 79 and 162.

With respect to black colorants, in addition to carbon black, titanium black, activated carbon, etc., magnetic particles such as magnetite, iron, ferrite may be used singly and in combination. In the case when an attempt is made to reproduce lines and graphic images such as characters, those toners without the gloss properties (luster properties) are preferably adopted, and in the case of reproducing images having color gradations such as photographs and pictures, those toners with the gloss properties (luster properties) are preferably adopted.

With respect to the amount of use of these colorants, the same values as those conventionally used may be adopted. Normally, in the case of color toners, the amount is set in the range of 2 to 8 parts by weight with respect to 100 parts by weight of the binder resin, and more preferably, 2 to 5 parts by weight. In the case of black toners, the amount is set in the range of 4 to 15 parts by weight, and more preferably, 5 to 12 parts by weight.

Besides the above-mentioned colorants, desired additives, such as a charge-control agent and an anti-offset agent, may be added to the toner particles of the present invention.

With respect to the charge-control agent, complexes such as zinc salicylate complex, and other known charge-control agents maybe used, and the kinds thereof are preferably selected in accordance with the purpose of use. For use in copying color images, colorless, white or thin yellow charge-control agents are preferably adopted. For use in copying black images, there is no specific limitation. An amount of use of the charge-control agent may be appropriately set in accordance with the purpose of use. Normally, the amount is set in the range of 0.1 to 10 parts by weight, and more preferably, 0.5 to 5 parts by weight, with respect to 100 parts by weight of the binder resin.

The anti-offset agent is not specifically limited. But, for example, the following materials may be used: polyethylene wax, oxidized polyethylene wax, polypropylene wax, oxidized polypropylene wax, carnauba wax, Sazol wax, rice wax, candelilla wax, jojoba oil wax, beeswax, etc. The application thereof makes it possible to improve the anti-offset properties, and also to reduce the problem of toner aggregation to toner regulating blades, developing sleeves and other members in the developing device (primary transferring process) for developing electrostatic latent images. In particular, it is preferable to use wax having an acid value ranging from 0.5 to 30 KOHmg/g from the viewpoint of the dispersing properties in the binder resin having the above-mentioned acid value. An amount of addition of the wax may be set in the range of 0.5 to 5 parts by weight, and more preferably, 1 to 3 parts by weight, with respect to 100 parts by weight of the binder resin.

In the full-color developing toner of the present invention, it is preferable to externally add a fluidizing agent to each of the toner particles containing the above-mentioned binder resin, colorants and desired additive agents such as the charge-control agent and the anti-offset agent, in order to improve the fluidity. The fluidizing agent may be added to the toner particles prior to their shape control for controlling the shape of toner particles without shape irregularity as described earlier. In this case, the added inorganic fine particles such as fluidizing agents are fixed on the surface of toner particles when subjected to the shape control. It is preferable that the inorganic fine particles added prior to the shape control are the one having a relatively small-particle size as described later. This makes it possible to improve the dispersing properties of the toner particles during processes, and consequently to reduce the irregularity of their shape. In this case, by controlling the kind and the amount of addition of the fluidizing agent, the charge stability and environmental stability of the toner can be improved, and moreover, it is possible to improve the transferring properties and developing properties (anti-fogging properties) of the toner. Moreover, in the present invention, the toner particles, which have been subjected to the shape control, may be also subjected to the externally addition of the fluidizing agent. Thus, it is possible to appropriately control the toner characteristics in the same manner as described earlier.

With respect to the fluidizing agent, the following materials are exemplified: various carbides such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamondcarbonlactam, various nitrides such as boron nitride, titanium nitride and zirconium nitride, borides such as zirconium boride, various oxides, such as iron oxide, chrome oxide, titanium oxide, calcium oxide, magnesium oxide, zinc oxide, copper oxide, aluminum oxide, silica, colloidal silica, strontium titanate and magnesium titanate, sulfides such as molybdenum disulfide, fluorides, such as magnesium fluoride and carbon fluoride, various metal soap such as aluminum stearate, calcium stearate, zinc stearate and magnesium stearate, and various non-magnetic inorganic fine particles such as talc and bentonite. These materials may be used singly and in combination.

It is preferable for these fine particles to be surface-treated by a known method by using treatment agents as follows: conventionally used hydrophobicizing agents such as silane coupling agents, titanate coupling agents, silicon oils and silicon varnishes; fluorine silane coupling agents or fluorine silicon oils; coupling agents containing amino-group/quaternary ammonium salt; and modified silicon oils.

From the viewpoint of stability for toner endurable static charge, it is preferable to use two or more kinds of fluidizing agent having different particle sizes. Moreover, the fluidizing agent preferably have a distribution within a required particle-size region. In other words, the addition of particles, etc. having a relatively smaller particle size (for example, inorganic fine particles such as hydrophobic silica having a BET specific surface area of 130 to 350 $m^2/g$, preferably 150 to 350 $m^2/g$) makes it possible to improve the fluidity of toner (properties controls for looseness apparent specific gravity, etc.), and the application of particles, etc. having a relatively greater particle size (for example, inorganic fine particles such as hydrophobic silica, titanium oxide, zinc oxide, or strontium titanate, each of which have a BET specific surface area of 1 to 130 $m^2/g$, preferably 5 to 110 $m^2/g$) makes it possible to control the aggregating properties between toner particles (properties controls for compacting apparent specific gravity, etc.). In this case, it is preferable that the difference of the BET specific surface area between the both is 30 $m^2/g$ or more. In particular, in order to improve the durability, it is preferable to add particles having a large particle size. By using such fluidizing agent, it becomes possible to stably maintain the toner fluidity from the initial time to the endurance time.

An amount of addition of these fluidizing agents is preferably set in the range of 0.6 to 5 parts by weight, more preferably 0.8 to 4 parts by weight, with respect to 100 parts by weight of toner particles. The amount of addition less than 0.6 part by weight fails to ensure desired copying properties and durability. The amount of addition exceeding 5 parts by weight fails to maintain the fluidizing agents on the surface of a toner particle, with the result that the materials separated from the toner particles cause side effects such as insufficient static charge, etc. In the case of two or more kinds of fluidizing agents, the total amount of addition of them is set in the above-mentioned range.

In order to improve the cleaning properties, it is preferable to use the above-mentioned fluidizing agents, such as strontium titanate, magnesium titanate, aluminum stearate, calcium stearate, zinc stearate and magnesium stearate, and/or the following cleaning assist agents:

The cleaning assist agents include various organic fine particles, such as styrene-series, (metha)acrylic-series, benzoguanamines, melamines, Teflon, silicons, polyethylene and polypropylene, which are granulated by wet polymerization methods and gaseous phase methods, such as emulsion polymerization method, soap-free emulsion polymerization method and nonaqueous dispersion polymerization method.

The external addition of the above-mentioned fluidizing agents to toner particles is carried out before and/or after the aforementioned surface-modifying treatment to the toner particles. The external addition of the fluidizing agents prior to the surface-modifying treatment makes it possible to improve the dispersing properties of the toner particles, to accelerate homogeneity at the time of the surface-modifying treatment, and consequently to reduce the standard deviation of the degree of roundness. After the surface-modifying treatment, in order to further achieve desired particle properties, it is preferable that the fluidizing agents are externally added within the above-mentioned range of amount of addition.

The full-color developing toner of the present invention, obtained as described above, is effectively used in a full-color image-forming method in which: a toner image formed on an image-supporting member is pressed and transferred onto an intermediate transfer member for each of colors in a superimposed manner, and the toner image transferred on the intermediate transfer member is pressed and transferred onto a recording member. In other words, in the full-color image-forming method using the above-mentioned toner of the present invention, it is possible to prevent image losses of toner images, scattering of toner and occurrences of image-fogging in full-color copied images, and also to provide superior transferring properties and cleaning properties.

An explanation will be given of a full-color image-forming method using the above-mentioned full-color developing toner by exemplifying a known full-color image-forming apparatus shown in FIG. 2. In the full-color image-forming apparatus, a photosensitive member is used as the image-supporting member, an endless intermediate transfer belt is used as the intermediate transfer member, and a sheet of recording paper is used as the recording member.

Figure 2:
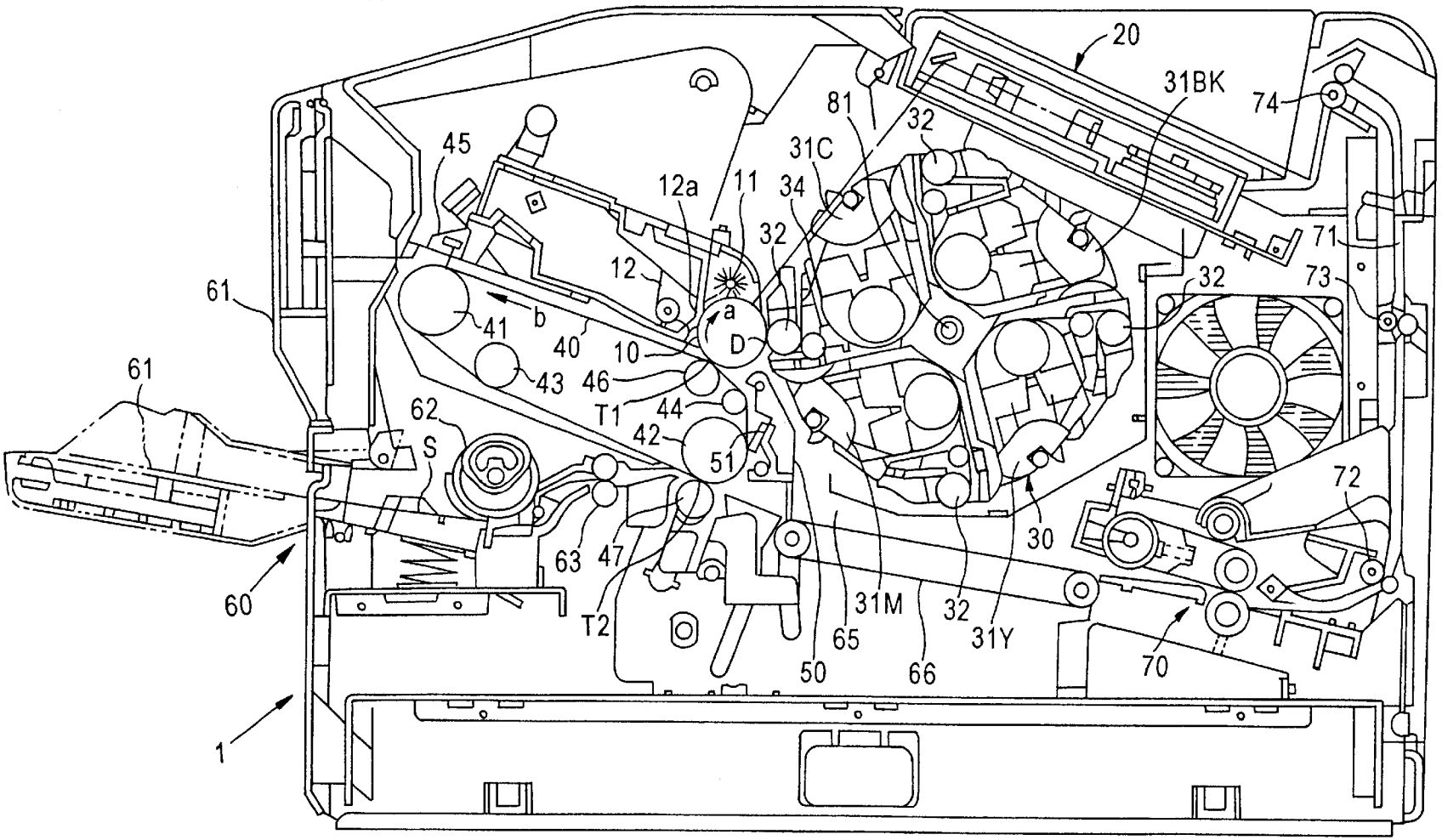
FIG. 2 is a schematic drawing that shows the structure of a full-color image-forming apparatus.

In FIG. 2, the full-color image-forming apparatus is schematically constituted by a photoconductive drum 10 that is rotationally driven in the arrow a direction, a laser scanning optical system 20, a full-color developing device 30, an endless intermediate transfer belt 40 that is rotationally driven in the arrow b direction, and a paper-feed section 60. On the periphery of the photoconductive drum 10 are further installed a charging blush 11 for charging the surface of the photoconductive drum 10 to a predetermined electric potential, and a cleaner 12 having a cleaner blade 12*a* for removing toner remaining on the photoconductive drum 10.

The laser scanning optical system 20 is a known system equipped with a laser diode, a polygon mirror and an fθ optical element, and its control section receives print data classified into C(cyan), M(magenta), Y(yellow) and Bk (black) from a host computer. The laser scanning optical system 20 outputs print data for the respective colors successively as laser beams, thereby scanning and exposing the photoconductive drum 10. Thus, electrostatic latent images for the respective colors are successively formed on the photoconductive drum 10.

The full-color developing device 30 is integrally provided with four developing devices 31Y, 31M, 31C and 31Bk separated for housing the non-magnetic toners Y, M, C and Bk respectively, and is allowed to rotate clockwise on a supporting shaft 81 as a supporting point. Each developing device has a developing sleeve 32 and a toner regulating blade 34. Toner, which is fed by the rotation of the developing sleeve 32, is charged when it is allowed to pass through a contact section (gap) between the blade 34 and the developing sleeve 32.

With respect to the installation positions of the developing devices housing the respective toners, or yellow toner, magenta toner, cyan toner and black toner, these positions are dependent on purposes of copying processes, that is, whether the purpose of the full-color image-forming apparatus is to copy line and graphic images such as characters or to copy images having gradations in respective colors such as photographic images. For example, in the case of copying of line and graphic images such as characters, a kind of toner having no gloss properties (luster) is used as black toner, and in this case, when the black toner layer is formed as the uppermost layer on a full-color copied image, inconsistency appears thereon; therefore, the black toner is preferably attached to the developing device so as not to form the black toner layer as the uppermost layer on a full-color copied image. It is most preferable to attach the black toner so that the black toner layer is formed as the lowermost layer on copied images, that is, so that, in the primary transfer process, the black toner layer is formed as the uppermost layer on the intermediate transfer member.

Therefore, the yellow toner, magenta toner, and cyan toner (color toners) are attached to the developing device arbitrarily so that in the primary transfer process, each of the layers is formed as any of the first through third layers in the order of formation thereof.

From the viewpoint of copying efficiency also, it is preferable not to directly form the black toner layer on the intermediate transfer member in the primary transfer process. In the case when the black toner layer is directly formed on the intermediate transfer member, since the average degree of roundness of the toner particles in the toner layer is relatively low, the contact area between the particle and the transfer member increases; this makes the multiple toner layers difficult to separate from the transfer member in the secondary transfer process, resulting in image losses and scattering, and causing image noise.

In contrast, in the case of copying of images having gradations in respective colors such as photographic images, a kind of toner having a gloss properties (luster) is used as the black toner, and even if the black toner layer is formed as the uppermost layer on copied images, no inconsistency occurs in relation to the other color toner layers.

The intermediate transfer belt 40 is mounted over support rollers 41 and 42 and tension rollers 43 and 44 in an endless from, and is rotationally driven in the arrow b direction in synchronism with the photoconductive drum 10. A protrusion (not shown) is placed on the side of the intermediate transfer belt 40, and a micro-switch 45 detects the protrusion so that the image-forming processes, such as exposure, developing and transferring, are controlled. The intermediate transfer belt 40 is pressed by a primary transfer roller 46 that is freely rotatable so as to come into contact with the photoconductive drum 10. This contact section forms a primary transfer section $T_1$. Moreover, the intermediate transfer belt 40 comes into contact with a secondary transfer roller 47 that is freely rotatable at its portion supported by the support roller 42. This contact portion forms a secondary transfer section $T_2$.

A cleaner 50 is installed in a space between the developing device 30 and the intermediate transfer belt 40. The cleaner 50 has a blade 51 for removing residual toner from the intermediate transfer belt 40. This blade 51 and the secondary transfer roller 47 are detachably attached to the intermediate transfer belt 40.

The paper-feed section 60 is constituted by a paper-feed tray 61 that is freely opened on the front side of the image-forming apparatus main body 1, a paper-feed roller 62 and a timing roller 63. Recording sheets S are stacked on the paper-feed tray 61, and fed to the right in the FIG. one sheet by one sheet in accordance with the rotation of the paper-feed roller 62, and then transported to the secondary transfer section in synchronism with an image formed on the intermediate transfer belt 40 by the timing roller 63. A horizontal transport path 65 for recording sheets is constituted by an air-suction belt 66, etc. with the paper-feed section being included therein, and a vertical transport path 71 having transport rollers 72, 73 and 74 extends from the fixing device 70. The recording sheets S are discharged onto the upper surface of the image-forming apparatus main body 1 from this vertical transport path 71.

Next, an explanation will be given of the printing process of the full-color image-forming apparatus.

When a printing process is started, the photoconductive drum 10 and the intermediate transfer belt 40 are rotationally driven at the same peripheral velocity, and the photoconductive drum 10 is charged to a predetermined electric potential by the charging brush 11.

Successively, exposure for a yellow image is carried out by the laser scanning optical system 20 so that an electrostatic latent image of the yellow image is formed on the photoconductive drum 10. This electrostatic latent image is directly developed by the developing device 31Y, and the toner image is transferred onto the intermediate transfer belt 40 at the primary transfer section. Immediately after the completion of the primary transferring process, switching is made to the developing device 31M in the developing section D, and successively, exposure, developing and primary transferring processes are carried out for a magenta image. Switching is further made to the developing device 31C, and exposure, developing and primary transferring processes are carried out for a cyan image. Switching is further made to the developing device 30 Bk, and exposure, developing and primary transferring processes are carried out for a black image. Thus, the toner images are superimposed one by one on the intermediate transfer belt 40 for the respective primary transferring processes 1.

When the final primary transferring process is completed, a recording sheet S is sent to the secondary transfer section, and a full-color toner image, formed on the intermediate transfer belt 40, is transferred onto the recording sheet S. Upon completion of this secondary transferring process, the recording sheet S is transported to a belt-type contact-heating fixing device 70 where the full-color toner image is fixed onto the recording sheet S; then, the recording sheet S is discharged onto the upper surface of the printer main body.

The full-color toner of the present invention may be effectively applied to the developing device which is operated based on the mono-component developing system wherein the toner is charged by allowing the toner to pass through the contact section between the toner regulating blade and the developing sleeve as described above, or based on the two-component developing system in which the toner is charged by friction with carriers. In general, since the stress imposed on the toner particle is greater in the mono-component developing system than in the two-component developing system, toners to be used in the mono-component system need to have a superior anti-stress properties, as compared with those used in the two-component developing system. Since the toner of the present invention is effectively used in both of the developing systems as described above, the toner of the present invention is more useful when used in the mono-component developing system.

In the following embodiments, a full-color image-forming apparatus having the above-mentioned arrangement was used under the conditions of a photoconductive-drum surface electric potential of −550 V, a developing bias voltage of −200 V, a primary transfer bias voltage of 900 V and a secondary transfer bias voltage of 500 V so as to achieve an amount of adhesion of toner on a solid image section on a recording sheet of 0.7 mg/cm$^2$, with a fixing temperature of 160° C.

Referring to the following embodiments, the present invention will be described in more detail.

In the embodiments, "parts" represent "parts by weight", unless otherwise referred to.

(Preparation of Polyester Resin A)

Four (4.0) moles of polyoxypropylene(2,2)-2,2-bis(4-hydroxyphenyl)propane (hereinafter, referred to as "PO"), 6.0 moles of polyoxyethylene (2,0)-2,2-bis(4-hydroxyphenyl)propane (hereinafter, referred to as "EO"), 9.0 moles of terephthalic acid (hereinafter, referred to a "TPA") and dibutyltinoxide as a catalyst were put ino a four-necked glass flask to which a thermometer, a stainless stirring stick, a dropping-type condenser and a nitrogen inlet tube were attached. The ingredients were heated and allowed to react while being stirred in a nitrogen gas flow on a mantle heater.

The progress of this reaction was checked by measuring its acid value. When a predetermined acid value was achieved, the reaction was stopped, and the temperature was lowered to room temperature. Thus, polyester resin A was obtained.

(Preparation of Polyester Resin B)

Polyester resin B was obtained by carrying out the same method as the preparation of polyester resin A except that materials having the compositions listed in Table 1 were used.

TABLE 1

| | Alcohol component | | Acid component | |
|---|---|---|---|---|
| Mole Ratio | PO | EO | FA | TPA |
| Polyester Resin B | 2.5 | 7.5 | 7.5 | 5.0 |

"FA" represents fumaric acid.

Properties of polyester resins A and B are summarized in Table 2.

TABLE 2

| Resin | Mn | Mw/Mn | Tg (° C.) | Tm (° C.) | Acid Value (mgKOH/g) | OH Value (mgKOH/g) |
|---|---|---|---|---|---|---|
| A | 3,300 | 4.2 | 68.5 | 110.3 | 3.3 | 28.1 |
| B | 5,200 | 4.3 | 61.0 | 99.5 | 24.9 | 19.1 |

(Preparation of Polyester Resin C)

In preparation of polyester resin C, 1376 g of the above-mentioned PO, 659 g of isophthalic acid and 90 g of diethyleneglycol were put in a 5-liter four-necked flask to which a reflux cooling condenser, a water separator, a nitrogen-gas inlet tube, a thermometer and a stirrer were attached. This flask was put on a mantle heater, and dehydrating polymerization condensation was carried out at a temperature ranging from 220 to 270° C., with nitrogen gas being introduced into the flask through the nitrogen-gas inlet tube. Thus, a low molecular weight polyester resin was obtained.

The above-mentioned PO (1720 g), 1028 g of isophthalic acid, 328 g of 1,6-dipropyl-1,6-hexanediol and 74.6 g of glycerin were put in a 5-liter four-necked flask to which a reflux cooling condenser, a water separator, a nitrogen-gas inlet tube, a thermometer and a stirrer were attached. This flask was put on a mantle heater, and dehydrating polymerization condensation was carried out at a temperature of 240° C., with nitrogen gas being introduced into the flask through the nitrogen-gas inlet tube. Thus, a polyester resin for further polymerization was obtained.

Then, 75 parts of the low molecular weight polyester resin and 25 parts of polyester resin for further polymerization were put in a Henshel mixer, and sufficiently mixed and stirred uniformly. To the obtained mixture, 40 parts of diphenylmethane-4,4-diisocyanate was added. The resultant mixture was allowed to react in a pressure kneader at 120° C. for one hour. The percentage of NCO was measured so as to confirm that residual isolated isocyanate groups no longer existed. Thus urethane-modified polyester resin C having a softening point (Tm ) of 118° C., a flow-starting temperature (Ti) of 98° C. and a glass transition point (Tg) of 61° C.

The softening point was measured by a Flow Tester (CFT –500; made by Shimadzu K.K.). One (1.0) to 1.5 g of the resin was measured, and pressed with a pressure of 180 kg/cm$^2$ by using a molding device for 1 minute. This pressed sample was tested by the Flow Tester under the following conditions: Then, a temperature at which a ½ of the quantity of the sample was flown out was defined as the softening point. RATE TEM (heat-up rate); 3.0° C./min., SET TEMP; 50.0° C., MAX TEMP; 120.0° C., INTERVAL; 2.0° C., PREHEAT; 2.0° C., LOAD; 30.0 kgf, DIE (DIA); 1.0 mm, DIE (LENG); 1.0 mm, PLUNGER; 1.0 cm$^2$.

The temperature at which the sample started flowing out was defined as the flow-starting temperature.

The glass transition point was measured by a differential scanning calorimeter (DSC-200; made by Seiko Denshi Kogyo K.K.).

Approximately 10 mg of the resin was weighed, and put into an aluminum pan. Alumina was put into the pan as reference. The sample was heated from room temperature to 200° C. with a heat-up rate of 30° C./min. so that it was melt-quenched; then, this was cooled and measurements were made in a temperature range of 20 to 150° C. at a heat-up temperature of 10° C./min. During this heat-up process, the shoulder value in endothermic peak in a main peak within the temperature range of 30 to 80° C. was defined as the glass transition point.

With respect to the acid value, a weighed sample was dissolved into an appropriate solvent and the number of mg of potassium hydroxide required for neutralize the acidic group thereof was calculated by using an indicator such as phenolphthalein.

With respect to the hydroxide value, a weighed sample was treated with acetic anhydride. The resulting acetylated sample was subjected to hydrolysis and the number of mg of potassium hydroxide required for neutralize the isolated acetate was calculated.

The measurements of number-average molecular weight (Mn) and weight-average molecular weight (Mw) were made under the following conditions by using gel-penetration chromatography, and these values were obtained by converting the measured values based on the calibration line formed by standard polystyrene.

Detector: RID-300 Type Differential Refractometer (made by Nippon Bunkou Kogyo K.K.)

Columm: A–80 M×2

Temperature: 35° C.

Solvent: THF

Rate of flow: 1.0 ml/min (Preparation of Pigment Master Batches a through c)

With respect to pigments used in the preparation of the following toners A through O, each of polyester resins used for the preparation of the respective toners and either C. I. Pigment Yellow 180, C.I. Pigment Blue 15-3 or C.I. Pigment Red 184 were put in a pressure kneader at a weight ratio of 7:3, and kneaded at 120° C. for one hour. The kneaded material was cooled and roughly pulverized by hammermill to give a pigment master batch having a pigment content of 30 wt %. Here, depending on the above-mentioned pigments used, the resulting master batches are successively referred to as master batch a, master batch b or master batch c.

(Preparation of Toner A)

Ninety three (93) parts of polyester resin A, 10 parts of pigment master batch a, 2.0 parts of a zinc complex of salicylic acid (E-84; Orient Kagaku Kogyo K.K.) serving as a charge-control agent and 2 parts of oxidized molecular weight polypropylene (100 TS; Sanyo Kasei Kogyo K.K.: softening point 140° C., acid value 3.5) were sufficiently mixed in Henschel mixer. The mixture was fused and kneaded by using a twin screw extruding kneader (PCM-30;

made by Ikegai Tekkou K.K.) whose discharging section had been detached. The resulting kneaded matter was pressed and extended to a thickness of 2 mm by a cooling press roller, and cooled off by a cooling belt, and then roughly pulverized by a feather mill. The pulverized material was further pulverized and roughly classified by an Inomizer (INM-30; made by Hosokawa Micron K.K.) to have an average particle size of 5.9 μm. The obtained particles were classified finely by a rotor-type classifier (Teeplex; Type 100 ATP; made by Hosokawa Micron K.K.) to give toner particles having the following measurements: 6.2 μm in volume-average particle size (D), 0.1% by weight of particles having not less two times (2D) the volume-average particle size (D), and 3.8% by number of particles having not more than ⅓ (D/3) the volume-average particle size (D).

To 100 parts of these toner particles were added 0.5 part of hydrophobic silica having a BET specific surface area of 225 $m^2/g$ (TS-500; Cabot K.K.) and 1.0 part of hydrophobic titanium oxide having a BET specific surface area of 110 $m^2/g$ (STT-30A; made by Titan Kogyo K.K.) as fluidizing agents. The mixture was mixed at a peripheral velocity of 40 m/sec for 180 seconds by Henschel mixer, and then filtered through a vibration sieve (106 μm mesh (opening)) to give toner A.

(Preparation of Toner B and Toner C)

Toner B and toner C were respectively obtained by carrying out the same method as the preparation method of toner A except that pigment master batches b and c were used as the pigments.

(Preparation of Toner D)

Toner D was obtained in the same manner as the preparation method of toner A except for the following. A kneaded matter, which had been obtained in the same method as the preparation method of toner A, was pressed and extended to have 2 mm thickness by a cooling press roller, cooled off by a cooling belt, and then roughly pulverized by a feather mill. Thereafter, the pulverized matter was further pulverized and classified by a Jet pulverizer (IDS; made by Japan Pneumatic K.K.) to remove large particles and further classified finely by a DS classifier (made by Japan Pneumatic K.K.) to have an average particle size of 9 μm.

(Preparation of Toner E and Toner F)

Toner E and toner F were respectively obtained by carrying out the same method as the preparation method of toner D except that pigment master batches b and c were used as the pigments.

(Preparation of Toner G)

Toner particles were prepared in a manner similar to the preparation method of toner A except for the following. As materials, 100 parts of polyester resin C, 5 parts of carbon black (Mogul L; Cabot K.K.), 2.0 parts of a charge-control agent (Bontron S-34; made by Orient Kagaku Kogyo K.K.) and 2.5 parts of low molecular weight polypropylene (Viscol TS; made by Sanyo Kasei K.K.) were used, and a volume average particle size of toner particles changed to 7.5 μm.

To 100 parts of the obtained toner particles was added 0.8 part of hydrophobic silica (TS-500; Cabot K.K.) as a fluidizing agent. The mixture was mixed at a peripheral velocity of 30 m/sec for 90 seconds by Henschel mixer, and then filtered through a vibration sieve (106 μm mesh) to give toner G.

(Preparation of Toner H)

Toner H was obtained in the same method as the preparation method of toner A except that polyester resin B was used as the polyester resin and that low molecular weight polypropylene was not used.

(Preparation of Toner I and Toner J)

Toner I and toner J were respectively obtained in the same method as the preparation method of toner H except that pigment matches b and c were used as the pigments.

(Preparation of Toner K)

Toner particles were obtained in the same method as the preparation method of toner H except that 5 parts of carbon black (Mogul L; Cabot K.K.) was used as the pigment and that a volume average particle size of toner particles changed to 8.3 μm. To 100 parts of these toner particles was added 0.8 part of hydrophobic silica (TS-500; Cabot K.K.) as a fluidizing agent, and this was mixed at a peripheral velocity of 30 m/sec for 90 seconds by Henschel mixer, and then filtered through a vibration sieve (106 μm mesh), to give toner K.

(Preparation of Toners L through N)

To 100 parts of each kind of toner particles, obtained in the same method as the preparation methods of toners H through J, was added 0.5 part of hydrophobic silica (TS-500; made by Cabot K.K.), and was mixed by Henschel mixer at a peripheral velocity of 30 m/sec for 90 seconds. Each of the resulting toners was subjected to a surface treatment by a surface-modifying device as shown in FIG. 1 (Surfusing System; made by Nippon Pneumatic Kogyo K.K.) under the following conditions, and then to 100 parts of each of the particles were added 0.3 part of hydrophobic silica (TS-500; made by Cabot K.K.), 0.5 part of hydrophobic titanium oxide (STT-30A; made by Titan Kogyo K.K.) and 0.5 part of strontium titanate particles having a BET specific surface area of 9 $m^2/g$, and mixed by Henschel mixer at a peripheral velocity of 40 m/sec for 180 seconds. Thereafter, this was filtered through a vibration sieve (106 μm mesh), to give each of toners L through N. No toner aggregation was seen. Maximum temperature; 300° C., residence time; 0.5 sec., particle dispersion concentration; 100 $g/M^3$, temperature of cooling air flow; 18° C., temperature of cooling water; 20° C.

(Preparation of Toner O)

Sixty (60) parts of styrene, 35 parts of n-butylmethacylate, 5 parts of methacrylic acid, 0.5 part of 2,2-azobis-(2,4-dimethylvaleronitryl), 3 parts of low molecular weight polypropylene (Viscol 605P; made by Sanyo Kasei K.K.), 8 parts of carbon black (MA#8; made by Mitsubishi Kagaku K.K.) and 1 part of chrome complex (Aizen Spilon Black TRH; made by Hodogaya Kagaku K.K.) were mixed by a sand stirrer so that polymerization composition was prepared. This polymerization composition was polymerized in a 3% aqueous solution of Arabic rubber at a temperature of 60° C. for six hours, while being stirred at the number of revolutions of 4,000 rpm by using a stirrer TK Autohomomixer (made by Tokushukika Kogyo K.K.). Thus, globular particles having an average particle size of 6.2 μm were obtained. These globular particles were subjected to repeated filtration/washing processes, and the filtrated matter was sufficiently air-dried at 35° C. and 30% RH to give toner particles.

To 100 parts of the obtained toner particles was added 0.8 part of hydrophobic silica (TS-500; Cabot K.K.) as a fluidizing agent. The mixture was mixed at a peripheral velocity of 30 m/sec for 90 seconds by Henschel mixer, and then filtered through a vibration sieve (106 μm mesh) to give toner O.

(Preparation of Toner P through R)

To 100 parts of each of the toner particles obtained by the same method as the preparation methods of toners A through C was added 0.5 part of hydrophobic silica (TS-500; made by K.K.), and this was mixed at a peripheral velocity of 30 m/sec for 90 seconds by Henschel mixer. Each of the resulting toners was subjected to a surface treatment by a surface-modifying device as shown in FIG. 1 (Surfusing System; made by Nippon Pneumatic Kogyo K.K.) under the following conditions, and then to 100 parts of each of the toner particles were added 0.3 part of hydrophobic silica (TS-500; made by Cabot K.K.), 0.3 part of titanium oxide (STT-30A; made by Titan Kogyo K.K.) and 0.6 part of strontium titanate having a BET specific surface area of 9 $m^2/g$, and mixed by Henschel mixer at a peripheral velocity of 40 m/sec for 180 seconds. Thereafter, this was filtered through a vibration sieve (106 $\mu$m mesh) to give each of toners P through R. Here, no toner aggregation was seen after the surface treatment as described above. Maximum temperature; 250° C., residence time; 0.5 sec., particle dispersion concentration; 100 $g/m^3$, temperature of cooling air flow; 18° C., temperature of cooling water; 20° C.

(Preparation of Toners S through U)

Toners S through U were obtained by carrying out the same method as the preparation method of toners L through N, except that 0.3 part of hydrophobic silica having a BET specific surface area of 170 $m^2/g$ (R-974; made by Nippon Aerosil K.K) and 0.6 part of strontium titanate having a BET specific surface area of 9 $m^2/g$ were used as the fluidizing agent to be added after the surface treatment.

(Preparation of Toner V)

One hundred (100) parts of styrene-n-butylmethacrylate resin (Mn=3,500, Mw=1,600), 2.0 parts of a zinc metal complex of salicylic acid (E-84; Orient Kagaku Kogyo K.K.) and 4 parts of C. I. Pigment Yellow 180 were sufficiently mixed in Henschel mixer, and fused and kneaded by using a twin screw extruding kneader (PCM-30; made by Ikegai Tekkou K.K.). The resulting kneaded material was pressed and extended to have a thickness of 2 mm by a cooling press roller, and cooled off by a cooling belt, and then roughly pulverized by a feather mill. Thereafter, this was finely pulverized and roughly classified by Jet mill (IDS2-Type; made by Nippon Pneumatic Kogyo K.K.), and then further classified finely by a rotor-type classifier (Teeplex classifier Type 100 ATP; made by Hosokawa Micron K.K.). The resulting fine particles were further subjected to a globular-shaping treatment at 6,000 rpm for 3 minutes by using Hybridization system (made by Nara Kikai Seisakusho K.K.), to give toner particles. To 100 parts of the toner particles was added 0.5 part of hydrophobic silica having a BET specific surface area of 250 $m^2/g$ (R-976; made by Nippon Aerosil K.K) and was mixed by Henschel mixer at a peripheral velocity of 40 m/sec. for 90 seconds. Thereafter, this was filtered through a vibration sieve (106 $\mu$m mesh), to give toner V.

(Preparation of Toners W through X)

Toners W through X were obtained by carrying out the same method as the preparation method of toner V except that 4 parts of C.I. Pigment Blue 15-3 or C.I. Pigment Red 184 was used.

(Preparation of Toner Y)

Toner Y was obtained by carrying out the same method as the preparation method of toner V except that 8 parts of carbon black (Mogul L; Cabot K.K.) was used and that the globular-shaping treatment by using Hybridization system was not performed.

With respect to the toner particles obtained by the above-mentioned processes, the volume-average particle size, the weight ratio of particles having not less than two times (2D) the volume-average particle size (D), the number ratio of particles having not more than ⅓ (D/3) the volume-average particle size, the average degree of roundness and the standard deviation of degree of roundness are summarized and shown in Table 3.

TABLE 3

| Toner | | Volume Average Particle Size (D) ($\mu$m) | Not less than 2D (Weight %) | Not more than D/3 (Number %) | Average Degree of Round-ness | Standard Deviation |
|---|---|---|---|---|---|---|
| A | Yellow | 6.2 | 0.1 | 3.8 | 0.953 | 0.036 |
| B | Cyan | 6.4 | 0.1 | 4.2 | 0.953 | 0.035 |
| C | Magenta | 6.3 | 0.1 | 4.0 | 0.954 | 0.035 |
| D | Yellow | 9.4 | 0.3 | 8.6 | 0.938 | 0.053 |
| E | Cyan | 9.4 | 0.3 | 8.6 | 0.938 | 0.053 |
| F | Magenta | 9.4 | 0.3 | 8.6 | 0.938 | 0.053 |
| G | Black | 7.5 | 0.1 | 4.8 | 0.942 | 0.042 |
| H | Yellow | 6.2 | 0.1 | 5.2 | 0.957 | 0.043 |
| I | Cyan | 6.2 | 0.1 | 5.6 | 0.956 | 0.041 |
| J | Magenta | 6.1 | 0.0 | 5.4 | 0.956 | 0.042 |
| K | Black | 8.3 | 0.1 | 3.7 | 0.948 | 0.044 |
| L | Yellow | 6.0 | 0.1 | 4.3 | 0.987 | 0.029 |
| M | Cyan | 6.1 | 0.1 | 4.7 | 0.986 | 0.030 |
| N | Magenta | 6.0 | 0.1 | 4.6 | 0.986 | 0.030 |
| O | Black | 6.1 | 0.1 | 4.6 | 0.991 | 0.036 |
| P | Yellow | 6.2 | 0.1 | 3.0 | 0.982 | 0.029 |
| Q | Cyan | 6.4 | 0 | 3.9 | 0.981 | 0.030 |
| R | Magenta | 6.4 | 0 | 3.7 | 0.982 | 0.028 |
| S | Yellow | 6.0 | 0.1 | 4.3 | 0.987 | 0.029 |
| T | Cyan | 6.1 | 0.1 | 4.7 | 0.986 | 0.030 |
| U | Magenta | 6.0 | 0.1 | 4.6 | 0.986 | 0.030 |
| V | Yellow | 6.8 | 0.1 | 4.8 | 0.957 | 0.040 |
| W | Cyan | 6.7 | 0.1 | 4.6 | 0.957 | 0.041 |
| X | Magenta | 6.8 | 0.1 | 4.6 | 0.958 | 0.042 |
| Y | Black | 6.9 | 0.1 | 5.3 | 0.928 | 0.052 |

(Mono-component 1-ingredient Developing System)

EXAMPLE 1

A combination of toners A, B, C and G was selected as a full-color developing toner.

EXAMPLE 2

A combination of toners L, M, N and K was selected as a full-color developing toner.

EXAMPLE 3

A combination of toners H, I, J and K was selected as a full-color developing toner.

EXAMPLE 4

A combination of toners L, M, N and G was selected as a full-color developing toner.

EXAMPLE 5

A combination of toners P, Q, R and G was selected as a full-color developing toner.

Comparative Example 1

A combination of toners D, E, F and G was selected as a full-color developing toner.

Comparative Example 2

A combination of toners L, M, N and O was selected as a full-color developing toner.

Comparative Example 3

A combination of toners V, W, X and Y was selected as a full-color developing toner.

(Evaluation)

Each of the full-color developing toners selected in the above-mentioned examples and comparative examples was evaluated on the following items. The evaluation was made under under H/H environment (30° C., 85% RH) and L/L environment (10° C., 15% RH). In example 5 and comparative example 3, after an initial evaluation was made by using a predetermined print pattern under H/H and L/L environments in the same manner as other examples 1 through 4 and comparative examples 1 and 2, 3,000-sheet continuous copying operations were carried out by; using a print pattern with a B/W ratio of 6% for each color under N/N environment (25° C., 50% RH). Evaluation was again made. The evaluation method carried out after the 3000-sheet continuous copying operations with respect to example 5 and comparative example 3 was the same as the evaluation method as described below, except that the evaluation was made under N/N environment, that the evaluation was made after the 3000-sheet copying operations and that the print pattern of 6% for each color was used.

Image Loss

The full-color developing toner was loaded in a full-color image-forming apparatus having a construction as shown in FIG. 2, and a full-color image (general pattern) was copied by means of 4-color-overlapping print. After 10 sheets were copied, a full-color copied image was evaluated based upon the following rank. The four kinds of toners were loaded so as to form layers of Y, M, C and Bk in this order from the bottom on the intermediate transfer belt.

○: No image loss occurred on copied images;

Δ: Slight image losses occurred on copied images, but no problem was raised in practical use;

×: Many image losses occurred on copied images, which caused a problem in practical use.

Scattering

The full-color developing toner was loaded in a full-color image-forming apparatus having a construction as shown in FIG. 2, and a full-color image (general pattern) was copied by means of 4-color-overlapping print. After 10 sheets were copied, a full-color copied image was observed visually and evaluated based upon the following rank. The four kinds of toners were loaded so as to form layers of Y, M, C and Bk in this order from the bottom on the intermediate transfer belt.

○: No toner scattering was observed around copied images of lines;

Δ: Slight toner scattering was observed around copied images of lines, but no problem was raised in practical use;

×: Much toner scattering was observed around copied images of line and recognized as stains, which caused a problem in practical use.

Blurring

The full-color developing toner was loaded in a full-color image-forming apparatus having a construction as shown in FIG. 2. Ten sheets of a character pattern having a B/W ratio of 30% was continuously copied by means of 4-color-overlapping print, and the copied images were observed visually and evaluated based upon the following rank. The four kinds of toners were loaded so as to form layers of Y, M, C and Bk in this order from the bottom on the intermediate transfer belt.

○: No fogging was observed around copied images of lines;

Δ: Slight fogging was observed around copied images of lines, but no problem was raised in practical use;

×: Fogging existed all over the surface, which caused a problem in practical use.

Transferring Properties

The full-color developing toner was loaded in a full-color image-forming apparatus having a construction as shown in FIG. 2, and six kinds (6 colors) of solid patterns, that is, yellow, magenta, cyan, red, green and blue (hereinafter, referred to as Y, M, C, R, G and B), were copied. After the 10th copying process was finished, a ratio of the quantity of toner adhesion on the paper to the quantity of adhesion of the toner on the photoconductive drum was observed and evaluated based on the following rank:

○: The above-mentioned ratio was not less than 80% in all the six kinds of patterns;

Δ: With respect to the six kinds of patterns, the minimum value of the above-mentioned ratio was not less than 70% and less than 80%;

×: With respect to the six kinds of patterns, the minimum value of the above-mentioned ration was less than 70%.

Cleaning properties

The full-color developing toner was loaded in a full-color image-forming apparatus having a construction as shown in FIG. 2, and 2 by 2 pattern images for the respective colors were continuously copied by means of 4-color-overlapping print. After 10 sheets was copied, the residual toner on the photoconductive drum was separated by using a tape, and visually observed and evaluated based upon the following rank. The four kinds of toners were loaded so as to form layers of Y, M, C and Bk in this order from the bottom on the intermediate transfer belt.

○: No toner was left after cleaning

×: Residual toner existed after cleaning.

The results of evaluation on examples 1 through 4 and comparative examples 1 and 2 are shown in Table 4. The results of evaluation on example 5 and comparative example 3 are shown in Table 5. In the evaluation of comparative example 3, when copying process was repeated 1,000 times continuously, accumulation of toner adhered to the regulating blade occurred, resulting in image noise in the form of a number of lines in copied sample images, so that the durability test was no longer continued and stopped.

TABLE 4

| | Examples | | | | | | | | Comparative Examples | | | |
|---|---|---|---|---|---|---|---|---|---|---|---|---|
| | 1 | | 2 | | 3 | | 4 | | 1 | | 2 | |
| | H/H | L/L | H/H | L/L | H/H | L/L | H/H | L/L | H/H | L/L | H/H | L/L |
| Image loss | ○ | ○ | ○ | ○ | ○ | ○ | ○ | ○ | X | ○ | ○ | ○ |
| Scattering | ○ | ○ | ○ | ○ | ○ | ○ | ○ | ○ | ○ | ○ | ○ | ○ |
| Fogging | ○ | ○ | ○ | ○ | ○ | ○ | ○ | ○ | ○ | ○ | ○ | ○ |
| Transferring properties | ○ | ○ | ○ | ○ | ○ | ○ | ○ | ○ | ○ | ○ | ○ | ○ |

TABLE 4-continued

| | Examples | | | | | | | | Comparative Examples | | | |
|---|---|---|---|---|---|---|---|---|---|---|---|---|
| | 1 | | 2 | | 3 | | 4 | | 1 | | 2 | |
| | H/H | L/L | H/H | L/L | H/H | L/L | H/H | L/L | H/H | L/L | H/H | L/L |
| Cleaning properties | — | ○ | — | ○ | — | ○ | — | ○ | — | ○ | — | X |

"—" indicates that no evaluation was made.

TABLE 5

| | Example 5 | | | Comparative Example 3 | | |
|---|---|---|---|---|---|---|
| | Initial. | | Durability | Initial | | Durability |
| | H/H | L/L | N/N | H/H | L/L | N/N |
| Image loss | ○ | ○ | ○ | X | Δ | — |
| Scattering | ○ | ○ | ○ | ○ | ○ | — |
| Fogging | ○ | ○ | ○ | ○ | ○ | — |
| Transferring properties | ○ | ○ | ○ | Δ | Δ | — |
| Cleaning properties | ○ | ○ | ○ | ○ | ○ | — |

"—" indicates that no evaluation was made.

(2-component Developing System)

EXAMPLE 6

A combination of toners S, T, U and K was selected as a full-color developing toner. A carrier, which will be described later, was mixed with the respective toners at a toner mixing ratio of 5% by weight.

Comparative Example 4

A combination of toners V, W, X and Y was selected as a full-color developing toner. A carrier, which will be described later, was mixed with the respective toners at a toner mixing ratio of 5% by weight.

(Evaluation)

With respect to the toners of example 6 and comparative example 4, five thousand (5,000) sheets of copies were made under N/N (25° C., 50%) environment by using a digital full-color copying machine CF 900 (made by Minolta K.K.). Evaluation was made at initial stage (10th sheet copy) and after 5,000 sheets of copy. The evaluation was ranked as follows.

Aggregation (White Spot)

With respect to each of the toners, images with a B/W of 15% were copied on 5,000 sheets of paper under N/N environment by using the CF900. After 5,000 sheets of copies, solid images (ID=1.2) on whole sheet were copied on three A-3 sheets of paper. The evaluation was made based on the following criteria. The results of evaluation were given as the average value of the three sheets. With respect to the first three sheets, evaluation was made in the same manner. The criteria of evaluation is shown as follows:

×: Image irregularity (white spot) having an ID not more than ½ the ID of the solid image with a size of not less than 2 $mm^2$ in copied solid images.

Δ: Although the above white spot did not exist, a core of aggregate of approximately 0.3 μm was observed in the copied images and the periphery of the core had a slight reduction in the image density; not less than three of these portions were observed in the image;

○: One to two of the above-mentioned image-density reduction portions were observed;

◎: No image-density reduction portion was observed.

Gradation (Quality of Halftone Image)

A gradation pattern with 0 to 256 tones was formed and was copied continuously. The copied images were evaluated at an initial stage and after 5,000 sheets of copy, and ranked as follows.

○: Uniform images without irregularity from the highlighted portion to solid portions were obtained;

Δ: Although irregularity was observed in the highlighted portion, no problem was raised in practical use;

×: Irregularity and unevenness occurred from halftone density areas to the highlighted portion.

Transferring Properties

With respect to transferring properties, solid patterns of 6 kinds (6 colors), Y, M, C, R, G and B, were developed on the photoconductive drum by using a digital copying machine (CF900; made by Minolta K.K.). Immediately after developed images was transferred onto a transfer sheet, the transfer sheet was drawn out. Evaluation was made on the basis a ratio of the quantity of toner adhesion on the transfer sheet to the quantity of toner adhesion on the photoconductive drum. The evaluation was ranked as follows. The evaluation was made on 10th and 5,000th copying processes.

○: The above ratio was not less than 90% in all the six kinds of patterns;

Δ: With respect to the six kinds of patterns, the minimum value of the above ratio was not less than 85% and less than 90%;

×: With respect to the six kinds of patterns, the minimum value of the above ratio was less than 85%.

Cleaning Properties

The organic photoconductive drum was observed visually at the initial stage and at the stage after the durability copying operation. Evaluation was ranked as ○ when there was no adhesion of toner particles that passed through the cleaning blade. Evaluation was made as × when, although slight adhesion of toner particles was observed; no noise appeared in the copied images. Evaluation was made as × when there was adhesion of toner particles and noise observed in the copied images.

Results of evaluation on the above-mentioned example 6 and comparative example 4 are shown in Table 6.

TABLE 6

| | Example 6 | | Comparative Example 4 | |
|---|---|---|---|---|
| | Initial N/N | Durability N/N | Initial N/N | Durability N/N |
| Aggregation | ○ | ○ | ○ | X |
| Transferring properties | ○ | ○ | Δ | X |

TABLE 6-continued

| | Example 6 | | Comparative Example 4 | |
|---|---|---|---|---|
| | Initial N/N | Durability N/N | Initial N/N | Durability N/N |
| Gradation | ○ | ○ | Δ | X |
| Cleaning properties | ○ | ○ | ○ | Δ |

(Preparation of Carrier)

One hundred (100) parts of methyl ethyl ketone was put into a 500-ml flask with a stirrer, a condenser, a thermometer, a nitrogen inlet tube and a dropping funnel. Separately, 36.7 parts of methyl methacrylate, 5.1 parts of 2-hydroxyethyl methacrylate, 58.2 parts of 3-methacryloxypropyltris(trimetylsiloxy)silane and 1 part of 1,1'-azobis(cyclohexane-1-carbonitryl) in 100 parts of methylethylketone were dissolved under a nitrogen atmosphere at 80° C. The obtained solution was dropped in the reaction container for two hours and matured for 5 hours. To the resulting resin was added as a crosslinking agent isophoronediisocyanate/trimethylolpropane adduct (NCO %=6.1%) so that its OH/NCO mole ratio was adjusted at 1/1, and this was then diluted by methyl ethyl ketone to give a resin-coating solution with a solid ratio of 3% by weight. Calcined ferrite particles F-300 (volume-average particle size: 50 μm made by Powder tech K.K.) was used as a core material. The above-mentioned resin-coating solution was applied by a SPIRA COTA (made by Okada Seiko K.K.) and dried so that a quantity of coated resin to the core material was set to 1.5% by weight. The carrier thus obtained was left to stand and baked in a hot air-circulating oven at 160° C. for one hour. After cooled, the ferrite particle bulk was pulverized by using a screening shaker provided with screen mesh opening of 106 μm and 75 μm. Thus, a resin-coated carrier was obtained.

The full-color developing toner of the present invention can avoid image losses in toner images and scattering of toner in the primary and secondary transferring processes, and also prevent image-fogging in full-color copied images. Transferring and cleaning properties are excellent. In the full-color image-forming method of the present invention, it is possible to avoid image losses in toner images and scattering of toner in the primary and secondary transferring processes, and also to prevent image-fogging in full-color copied images, being excellent in transferring and cleaning properties. The toner of the present invention maintains the above toner properties for a long time, that is, being excellent in durability. The toner of the present invention is effectively used in both of a mono-component developing system and the two-component developing system.

What is claimed is:

1. A full-color image-forming method comprising the steps of:

forming toner images of black toner on a recording medium; and superposing respective toner images of yellow toner, magenta toner and cyan toner on the back toner-images so that the black toner-images are positioned as a lowest under-part on the recording medium, wherein the black toner comprises black toner particles comprising at least a binder resin and a black colorant and having a standard deviation of degree of roundness of not more than 0.045;

the yellow toner comprises yellow toner particles comprising at least a binder resin and a yellow colorant and having a standard deviation of degree of roundness of not more than 0.045 and an average degree of roundness larger than that of the black toner particles, the magenta toner comprises magenta toner particles comprising at least a binder resin and a magenta colorant and having a standard deviation of degree of roundness of not more than 0.045 and an average degree of roundness larger than that of the black toner particles, the cyan toner comprises cyan toner particles comprising at least a binder resin and a cyan colorant and having a standard deviation of degree of roundness of not more than 0.045 and an average degree of roundness larger than that of the black toner particles, and wherein the binder resin contained respectively in the yellow toner particles, the magenta toner particles and the cyan toner particles has a glass transition point ranging from 55 to 75° C., a softening point ranging from 95 to 120° C., a number-average molecular weight ranging from 2,500 to 6,000 and a ratio of weight-average molecular weight/number-average molecular weight of 2 to 8.

2. The full-color image-forming method of claim 1, wherein the yellow toner particles, the magenta toner particles and the cyan toner particles have respectively the average degree of roundness of 0.95 to 1.00.

3. The full-color image-forming method of claim 1, wherein the yellow toner particles, the magenta toner particles and the cyan toner particles have respectively the average degree of roundness of 0.96 to 1.00 and the standard deviation of degree of roundness of not more than 0.040.

4. The full-color image-forming method of claim 1, wherein the black toner particles have the average degree of roundness of 0.94 to 0.97.

5. The full-color image-forming method of claim 1, wherein the black toner particles have the average degree of roundness of 0.95 to 0.97 and the standard deviation of degree of roundness of not more than 0.040.

6. The full-color image-forming method of claim 1, wherein the cyan toner-images are superposed on the black toner-images, the magenta toner-images are superposed on the cyan toner-images and the yellow toner-images are superposed on the magenta toner-images.

7. The full-color image-forming method of claim 1, wherein the yellow toner particles, the magenta toner particles and the cyan toner particles have first inorganic fine particles having a BET specific surface area of 1 to 130 $m^2/g$ and second inorganic fine particles having a BET specific surface area of 130 to 350 $m^2/g$, the first and second inorganic fine particles admixed externally to the respective toner particles, the BET specific surface area of the second inorganic fine particles being at least 30 $m^2/g$ larger than that of the first inorganic fine particles.

8. The full-color image-forming method of claim 7, wherein the black toner particles are admixed externally with third inorganic fine particles having a BET specific surface area of 1 to 350 $m^2/g$.

9. The full color image forming method of claim 1, wherein the yellow toner particles, the magenta toner particles and the cyan toner particles respectively have inorganic fine particles having a BET specific surface area of 1 to 350 $m^2/g$, said inorganic fine particles fixed on the surface of the each toner particles.

10. A full-color image-forming method comprising the steps of:

forming respective toner images of yellow toner, magenta toner and cyan toner on an intermediate transfer member; and superposing toner-images of back toner on the formed toner images so that the black toner-images are positioned as a highest upper-part on the intermediate transfer member;

transferring the superposed toner images to a recording medium, wherein the black toner comprises black toner particles comprising at least a binder resin and a black colorant and having a standard deviation of degree of roundness of not more than 0.045;

the yellow toner comprises yellow toner particles comprising at least a binder resin and a yellow colorant and having a standard deviation of degree of roundness of not more than 0.045 and an average degree of roundness larger than that of the black toner particles, the magenta toner comprises magenta toner particles comprising at least a binder resin and a magenta colorant and having a standard deviation of degree of roundness of not more than 0.045 and an average degree of roundness larger than that of the black toner particles, the cyan toner comprises cyan toner particles comprising at least a binder resin and a cyan colorant and having a standard deviation of degree of roundness of not more than 0.045 and an average degree of roundness larger than that of the black toner particles, and wherein the binder resin contained respectively in the yellow toner particles, the magenta toner particles and the cyan toner particles has a glass transition point ranging from 55 to 75° C., a softening point ranging from 95 to 120° C., a number-average molecular weight ranging from 2,500 to 6,000 and a ratio of weight-average molecular weight/number-average molecular weight of 2 to 8.

11. The full-color image-forming method of claim 10, wherein the yellow toner particles, the magenta toner particles and the cyan toner particles have respectively the average degree of roundness of 0.95 to 1.00.

12. The full-color image-forming method of claim 11, wherein the yellow toner particles, the magenta toner particles and the cyan toner particles have respectively the average degree of roundness of 0.96 to 1.00 and the standard deviation of degree of roundness of not more than 0.040.

13. The full-color image-forming method of claim 10, wherein the black toner particles have the average degree of roundness of 0.94 to 0.97.

14. The full-color image-forming method of claim 13, wherein the black toner particles have the average degree of roundness of 0.95 to 0.97 and the standard deviation of degree of roundness of not more than 0.040.

15. The full-color image-forming method of claim 10, wherein the yellow toner-images are formed on the intermediate transfer member, the magenta toner-images are superposed on the yellow toner-images, the cyan toner-images are superposed on the magenta toner-images and the black toner-images are superposed on the cyan toner-images.

16. The full-color image-forming method of claim 10, wherein the yellow toner a particles, the magenta toner particles and the cyan toner particles have first inorganic fine particles having a BET specific surface area of 1 to 130 $m^2/g$ and second inorganic fine particles having a BET specific surface area of 130 to 350 $m^2/g$, the first and second inorganic fine particles admixed externally to the respective toner particles, the BET specific surface area of the second inorganic fine particles being at least 30 $m^2/g$ larger than that of the first inorganic fine particles.

17. The full-color image-forming method of claim 16, wherein the black toner particles are admixed externally with third inorganic fine particles having a BET specific surface area of 1 to 350 $m^2/g$.

18. The full-color image-forming method of claim 10, wherein the yellow toner particles, the magenta toner particles and the cyan toner particles respectively have inorganic fine particles having a BET specific surface area of 1 to 350 $m^2/g$, said inorganic fine particles fixed on the surface of the each toner particles.

* * * * *